US012630348B2

(12) United States Patent
Li et al.

(10) Patent No.: US 12,630,348 B2
(45) Date of Patent: May 19, 2026

(54) PACKAGE ARRANGEMENT AND PACKAGING METHOD

(71) Applicant: HANGZHOU GREAT STAR INDUSTRIAL CO., LTD., Hangzhou City (CN)

(72) Inventors: Feng Li, Hangzhou City (CN); Yueming Li, Hangzhou City (CN)

(73) Assignee: HANGZHOU GREAT STAR INDUSTRIAL CO., LTD., Hangzhou City (CN)

( * ) Notice: Subject to any disclaimer, the term of this patent is extended or adjusted under 35 U.S.C. 154(b) by 41 days.

(21) Appl. No.: 18/693,645

(22) PCT Filed: Feb. 19, 2024

(86) PCT No.: PCT/CN2024/077515

§ 371 (c)(1),
(2) Date: Mar. 20, 2024

(87) PCT Pub. No.: WO2025/166837

PCT Pub. Date: Aug. 14, 2025

(65) Prior Publication Data

US 2025/0256898 A1 Aug. 14, 2025

(30) Foreign Application Priority Data

Feb. 8, 2024 (CN) ..... 202410177210.1

(51) Int. Cl.
*B65D 75/36* (2006.01)
*B65D 75/54* (2006.01)

(52) U.S. Cl.
CPC ..... *B65D 75/36* (2013.01); *B65D 75/54* (2013.01)

(58) Field of Classification Search
CPC ... B65D 5/50; B65D 5/52; B65D 5/54; B65D 73/00; B65D 75/36; B65D 75/52; B65D 75/54; B65D 73/0007; B65D 73/0014; B65D 73/0085; B65D 2565/386
USPC ..... 206/349, 462
See application file for complete search history.

(56) References Cited

U.S. PATENT DOCUMENTS 2,167,555 A * 7/1939 Sherman ..... B65D 5/5033 206/594
4,354,598 A * 10/1982 Schillinger ..... B65D 73/0085 206/476
4,549,654 A * 10/1985 Tiesman ..... B65D 73/0085 248/152
5,419,433 A * 5/1995 Harrer ..... B65D 5/50 206/312

(Continued)

FOREIGN PATENT DOCUMENTS

CN 101484368 A 7/2009
CN 111268283 A 6/2020

(Continued)

*Primary Examiner* — Bryon P Gehman
(74) *Attorney, Agent, or Firm* — Fitch, Even, Tabin & Flannery LLP

(57) ABSTRACT

A package arrangement includes a support board. The support board is formed of at least two layers of plate laminated and affixed together. Adjacent two plates of the at least two layers of plate define therebetween a cavity for receiving at least part of a hand tool. Each plate of the at least two layers of plate is fabricated from a material satisfying recycling requirements for the same class of materials.

11 Claims, 12 Drawing Sheets

(56) References Cited

U.S. PATENT DOCUMENTS

| | | | | |
|---|---|---|---|---|
| 2007/0295623 | A1 | 12/2007 | Brand | |
| 2015/0344207 | A1 | 12/2015 | Zacherle | |
| 2018/0303253 | A1* | 10/2018 | Wolf ..... | B65D 73/0085 |

FOREIGN PATENT DOCUMENTS

| | | | | |
|---|---|---|---|---|
| DE | 202005000861 | U1 | | 3/2005 |
| GB | 1097818 | A | | 5/1968 |
| GB | 1112959 | A | | 5/1968 |
| JP | 2000109153 | A | * | 4/2000 |

* cited by examiner

PACKAGE ARRANGEMENT AND PACKAGING METHOD

FIELD OF THE INVENTION

The present invention relates to the field of packaging technology and, in particular, to a package arrangement and a packaging method.

DESCRIPTION OF THE PRIOR ART

Existing display packages are typically common blister packs consisting essentially of a backing and a clear shell made of a plastic material. The backing is usually made of cardboard. The clear shell covers the cardboard and thus encloses the packaged item, rendering the item fully visible while being packaged. However, the use of the plastic material makes such blister-packed product display packages unfriendly to the environment and to consumers with strong environmental awareness. In addition, the plastic clear shell and the cardboard are combined together using heat and pressure. Consequently, the portions of them that are brought into contact to each other are inseparable, making it laborious for a user to open such a product display package to take out the packaged item. Moreover, this is not environmentally friendly. For example, the plastic clear shell and the cardboard may be very securely adhesively bonded to each other using heat and pressure. It would therefore be hard for a user to separate the clear shell from the cardboard. Even if the clear shell can be torn off from the cardboard, it tends to be the case that part of the cardboard remains attached to the clear shell. That is, the clear shell could not be completely separated from the cardboard. This will impede subsequent waste sorting, i.e., the components of the opened package cannot be disposed as recyclable waste. As another option, the user can directly cut the clear shell open with scissors or another tool and take the packaged item out. However, it would be laborious to cut a plastic material, and it remains impossible for the clear shell to be separated from the cardboard even after it is cut open. Thus, this approach is also not favorable to waste sorting. Further, it is associated with a high risk of scratching or otherwise damaging the packaged item.

Therefore, those skilled in the art are directing their effort toward developing a package arrangement and a packaging method. The package arrangement can be easily opened, is more environmentally friendly, can be produced at lower cost and is more aesthetically pleasing.

SUMMARY OF THE INVENTION

In view of the above-described disadvantages of the prior art, the problem sought to be solved by the present invention is how to overcome the problem that blister packs are not environmentally friendly and difficult to open.

To this end, the present invention provides a package arrangement comprising a support board. The support board is formed of at least two layers of plate laminated and affixed together. Adjacent two plates of the at least two layers of plate define therebetween a cavity for receiving at least part of a hand tool. Each plate of the at least two layers of plate is fabricated from a material satisfying recycling requirements for the same class of materials.

Additionally, the support board may define at least one opening provided thereat with a retention structure configured to define a position for a portion of the hand tool that is not received in the cavity.

Additionally, the at least two layers of plate may be made of paper materials.

Additionally, the at least two layers of plate may be adhesively bonded using pressure by an adhesive, which does not affect recycling.

Additionally, the support board may comprise a first panel and a second panel, which are laminated together and define the cavity therebetween.

Additionally, the first panel may define a first raised impression, wherein the second panel defines a second raised impression in positional correspondence with the first raised impression, and the first raised impression and the second raised impression together delimit the cavity.

Additionally, the first raised impression and the second raised impression may have a height of 1.5-2.5 mm.

Additionally, the height may be 2 mm.

Additionally, the first panel may define a first opening, wherein the second panel defines a second opening in positional correspondence with the first opening.

Additionally, the retention structure may comprise an extension formed by extending from an edge of the first opening into the first opening, the extension configured to extend into the hand tool so as to restrict the hand tool at a location allowing it to be taken out.

Additionally, the support board may form as a result of folding and laminating the first panel and the second panel, which are made from a single sheet.

Additionally, an edge portion of the first panel may be folded so as to delimit the cavity together with the second panel, wherein the cavity defines in a side wall thereof at least one first opening for passage of the hand tool therethrough into the cavity.

Additionally, the first panel may define a second opening, wherein the retention structure comprises an enclosure panel disposed at the second opening, the enclosure panel defining an accommodating space in which the hand tool is received.

Additionally, the enclosure panel may comprise a top and flanks at opposite sides of the top, the flanks joined to the support board from the second opening, the accommodating space formed between the top and the support board.

Additionally, the retention structure may comprise an accommodating space which forms as a result of folding the first panel, the accommodating space defining in a side wall thereof a second opening for passage of the hand tool therethrough.

This application also provides a method of packaging a hand tool in a package, which comprises:

providing a support board which forms as a result of laminating and affixing at least two layers of plate, wherein adjacent two plates of the at least two layers of plate define a cavity therebetween; the support board defines at least one opening provided thereat with a retention structure; and each plate of the at least two layers of plate is made of a material satisfying recycling requirements for the same class of materials; placing at least part of the hand tool in the cavity and engaging a portion of the hand tool that is not placed in the cavity with the retention structure; and affixing the at least two layers of plate of the support board together.

Additionally, the support board may be made of a paper material.

Additionally, a first panel and a second panel may be provided and laminated to form the support board, wherein the first panel defines a first raised impression and the second panel defines a second raised impression in positional correspondence with the first raised impression, the first raised impression and the second raised impression together delimiting the cavity; the first panel defines a first opening and the second panel defines a second opening in positional correspondence with the first opening; an edge of the first opening is extended into the first opening, thereby forming an extension; and a working end of the hand tool is placed in the cavity, and a handle of the hand tool is placed in an opening consisting of the first opening and the second opening, with the extension extending into the hand tool.

Additionally, the first panel and the second panel may be made from a single sheet so that there is a line of intersection between the first panel and the second panel, along which the first panel and the second panel are then folded so as to be laminated together.

Additionally, a first panel and a second panel may be provided, wherein an edge portion of the first panel is folded so as to delimit the cavity together with the second panel; the cavity defines in a side wall thereof at least one first opening; the first panel further defines a second opening provided thereat with an enclosure panel, which defines, together with the support board, an accommodating space therebetween; and a handle of the hand tool is passed through the first opening into the cavity, and a working end of the hand tool extends in the accommodating space.

Additionally, a first panel and a second panel may be provided, wherein an edge portion of the first panel is folded so as to delimit the cavity together with the second panel; the cavity defines in a side wall thereof at least one first opening; a middle portion of the first panel is folded so as to define, together with the second panel, an accommodating space where a second opening is provided; and a handle of the hand tool is passed through the first opening into the cavity, and a working end of the hand tool is passed through the second opening into the accommodating space.

This application has the advantageous effects as follows:

1. This application provides a plastic-free display package arrangement. Compared with blister-packed display packages, this application reduces the use of hazardous materials, or prevents excessive use of materials, resulting in increased environmental friendliness and reductions in cost. This is friendlier to consumers with strong environmental awareness
2. According to this application, cardboard panels are securely engaged by stamping with an item to be packaged. Compared with packaging using a plastic clear shell, this allows the resulting package to be easier to open. During use, cutting the cardboard is easier than cutting the plastic.
3. The package arrangement of the application is made essentially of cardboard. Compared with a display package including a clear plastic shell, information can be displayed on the package arrangement in a clearer and more aesthetically pleasing style. Moreover, there is a large area on the cardboard, in which more information of the packaged product can be displayed, facilitating consumers' identification and recognition.
4. The package arrangement of this application eliminates the need to use a plastic clear shell. Compared with blister-packed display packages which are three-layer structures, the package arrangement of the application is made of two cardboard laminates. This allows it to be directly subjected to waste sorting and recycling without a separating action taken by a consumer.

Below, the concept, structural details and resulting effects of the present invention will be further described with reference to the accompanying drawings to provide a full understanding of the objects, features and effects of the invention.

DETAILED DESCRIPTION OF THE PREFERRED EMBODIMENTS

Figure 1:
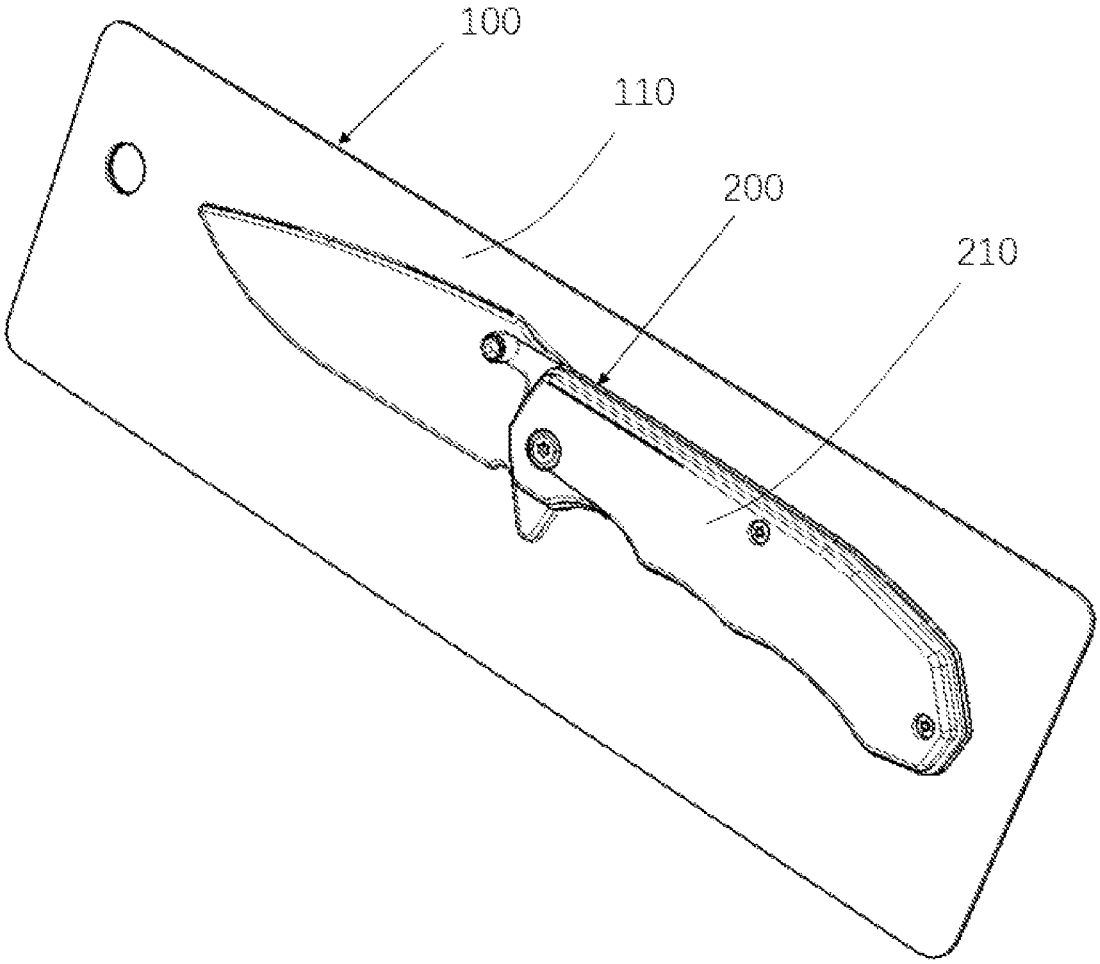
FIG. 1 is an isometric view of a first embodiment, showing a hand tool being packaged in a package arrangement.

A few preferred embodiments of the present invention will be described more fully hereinafter with reference to the accompanying drawings so that techniques thereof will become more apparent and more readily understood. The invention can be embodied in various different forms and its scope is in no way limited to the embodiments discussed herein.

Throughout the figures, structurally identical components are indicated with the same reference numerals, and structurally or functionally similar components are indicated with like reference numerals. The dimensions and thickness of each component in the accompanying drawings are arbitrarily shown, and the present invention is not limited to any particular dimension or thickness of any component. In the figures, where appropriate, the thickness of certain components may be somewhat exaggerated for clarity.

In the present application, there is provided a package arrangement 100 for packaging an item, preferably a hand tool. The package arrangement 100 includes a support board 110 having at least two layers of plate. The support board 110 is formed by laminating and securing together the at least two panels so that a cavity 113 is defined between adjacent two of the panels, in which the item can be at least partially received and thus kept within the package arrangement. In order to additionally secure the item, the support board 110 is provided with a retention structure, which can further restrict the item, enabling better securing of the hand tool 200. This can prevent the item from falling off during transportation or display, and from being stolen from sale.

The panels in the support board 110 are made of materials that satisfy recycling requirements for the same class of materials. In doing so, once the item is taken out, the package can be directly subjected to waste sorting without separation of the multiple panels. It should be appreciated that, here, by "materials that satisfy recycling requirements for the same class of materials", it is intended to mean that the panels are made of respective materials, which belong to a certain class of materials but may pertain to different sub-classes of the class. As long as these materials can be recycled as the same type of waste, they may not necessarily be of the same sub-class of materials. For example, when the panels are made of paper, it is not the case that all the panels are made of the same paper material. Rather, the panels may be made of different paper materials.

In one example, the item to be packaged is a hand tool 200 typically having a handle 210 and a working end 220, wherein the hand tool 200 may be placed in the package arrangement so that the handle 210 is partially or entirely received in the cavity 113, or that the working end 220 is partially or entirely received in the cavity 113. The rest of the hand tool 200 that is not received in the cavity 113 may be retained by the retention structure, providing additional securing of the hand tool 200. For example, at least one opening may be provided in the support board 110, and the retention structure may be disposed at the opening. The retention structure may define a portion of the hand tool at the opening. The concept of this application will be explained below by way of a few exemplary embodiments.

Example 1

Figure 2:
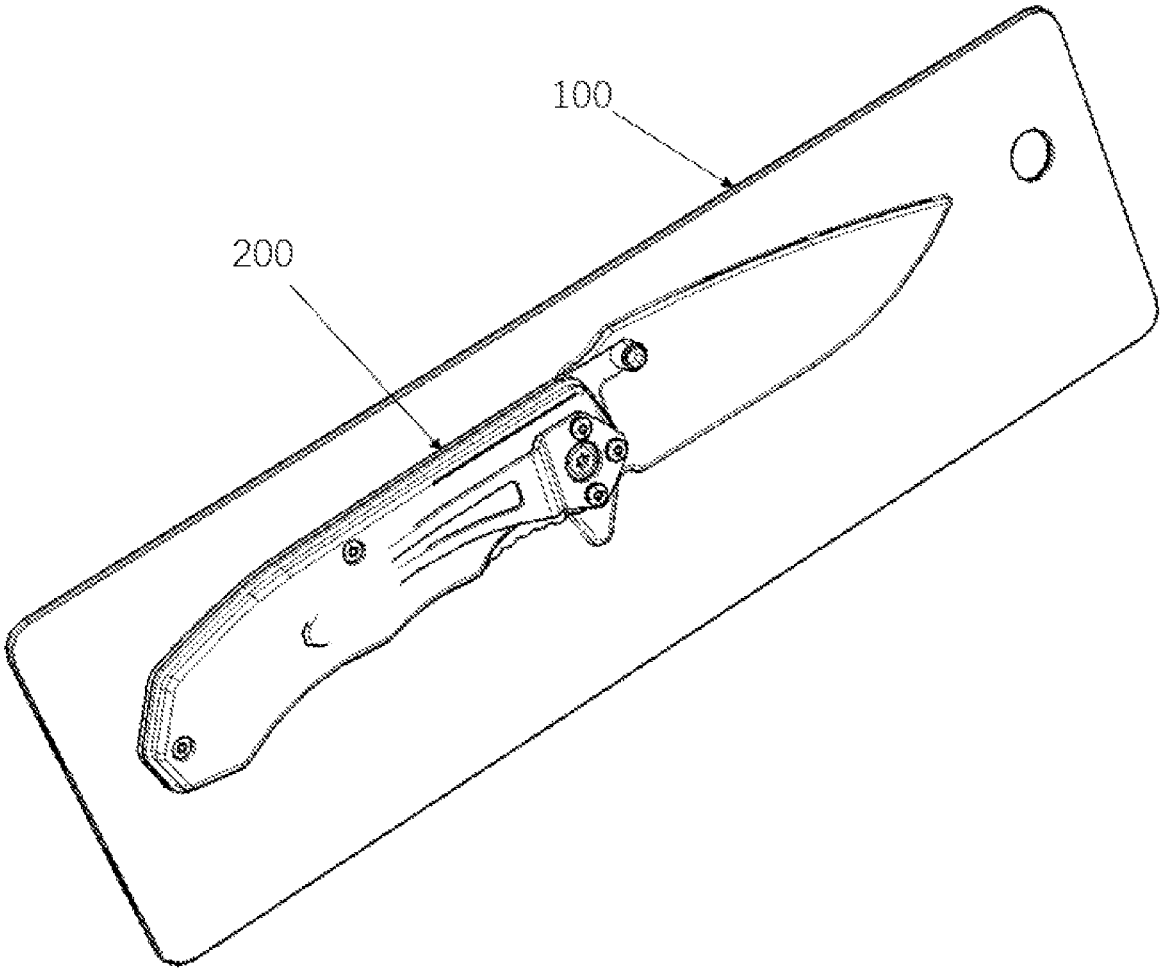
FIG. 2 is an isometric view of FIG. 1, taken from another angle.
Figure 3:
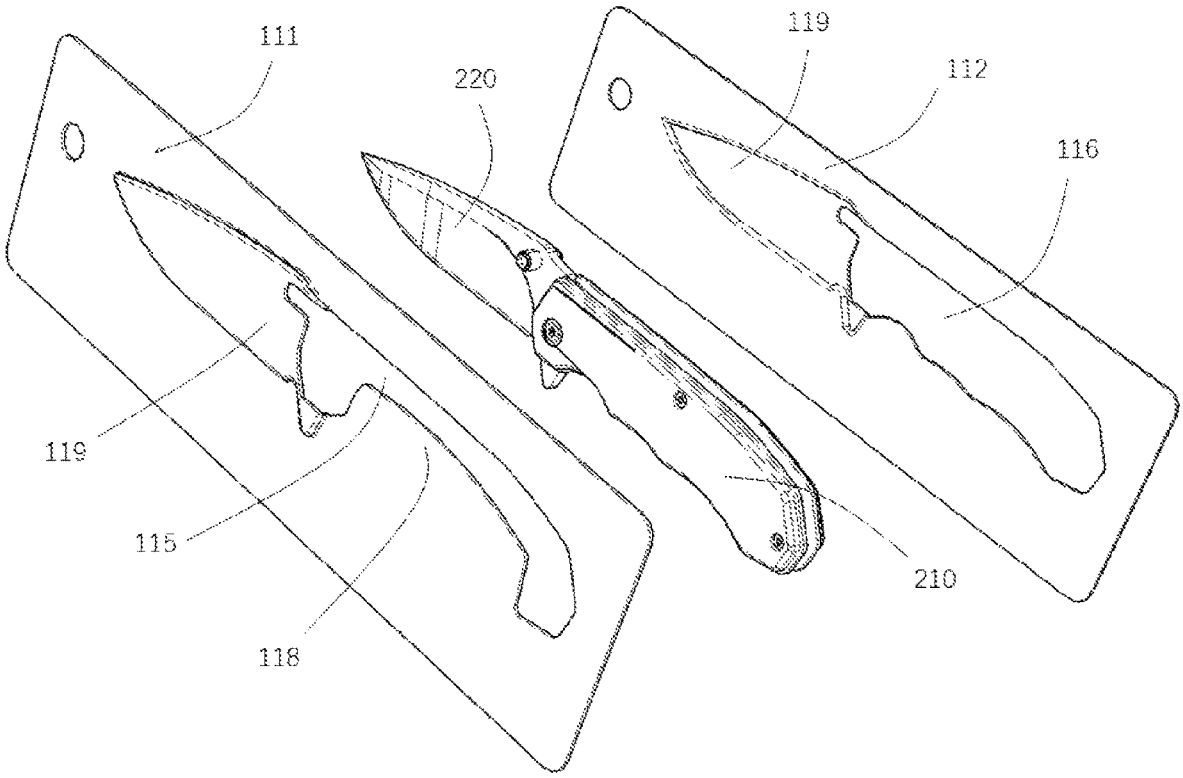
FIG. 3 is a schematic exploded view of FIG. 1.
Figure 4:
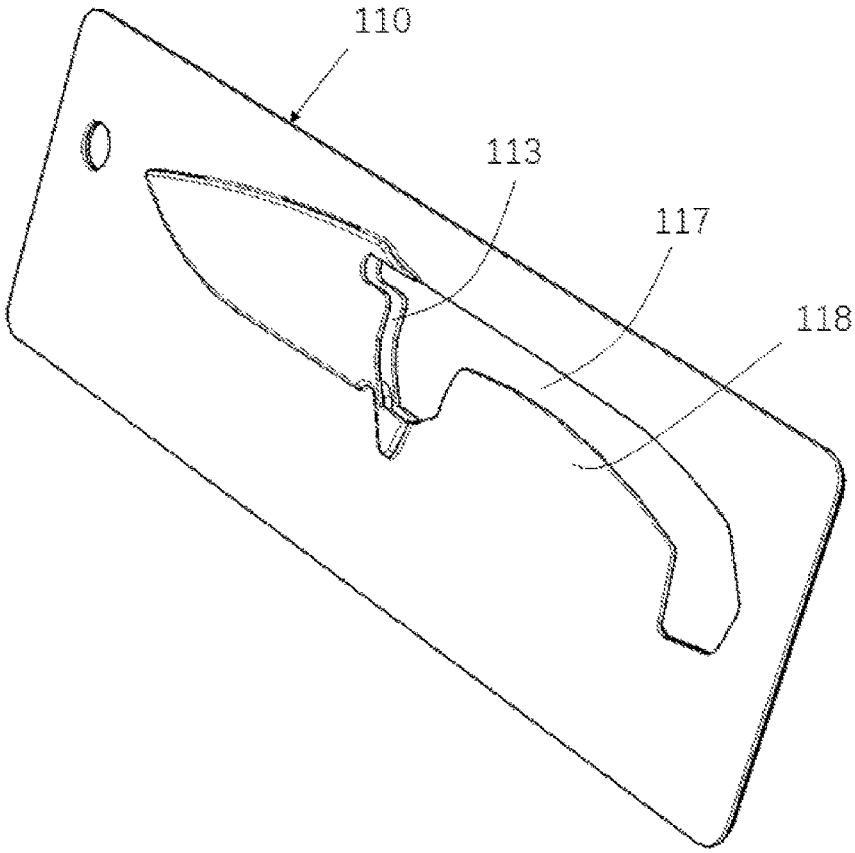
FIG. 4 is an isometric view of the package arrangement according to the first embodiment, in which the hand tool has not been packaged yet.
Figure 5:
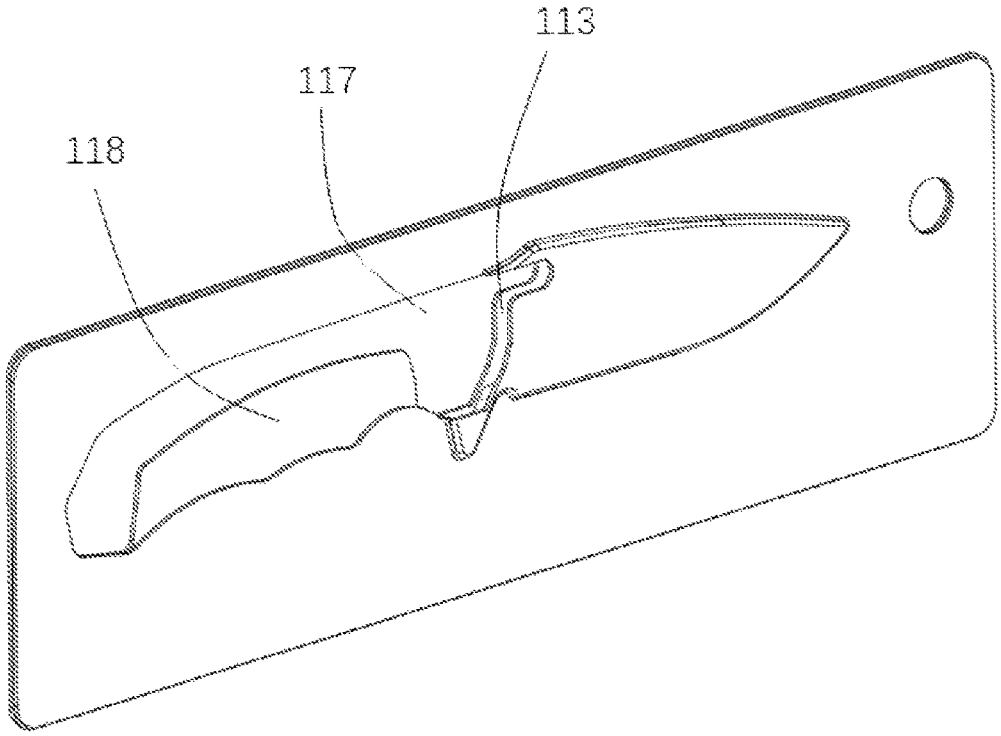
FIG. 5 is an isometric view of FIG. 4, taken from another angle.
Figure 6:
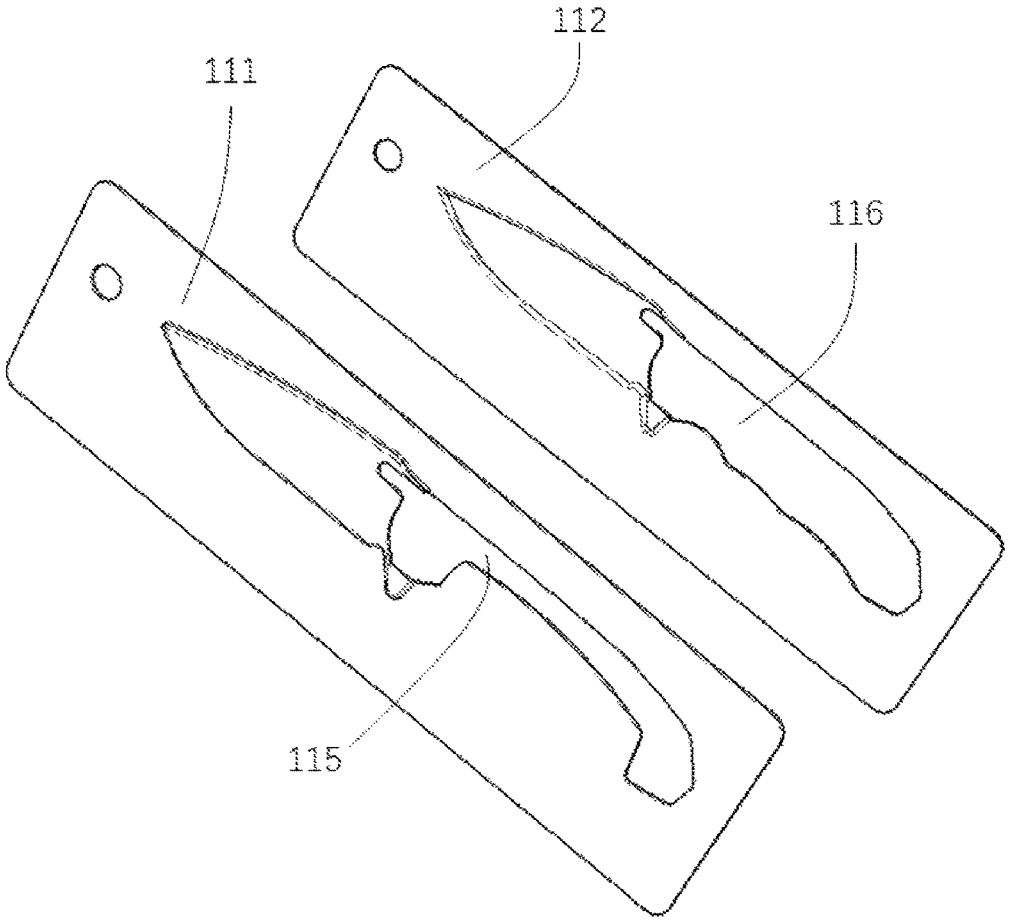
FIG. 6 is a schematic exploded view of FIG. 4.
Figure 7:
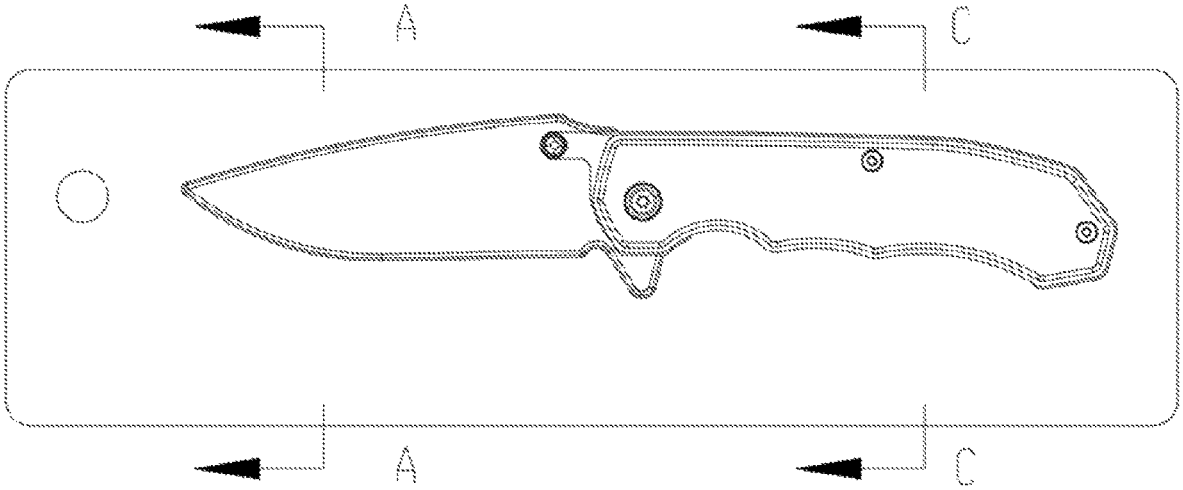
FIG. 7 is a front view of FIG. 1.
Figure 8:
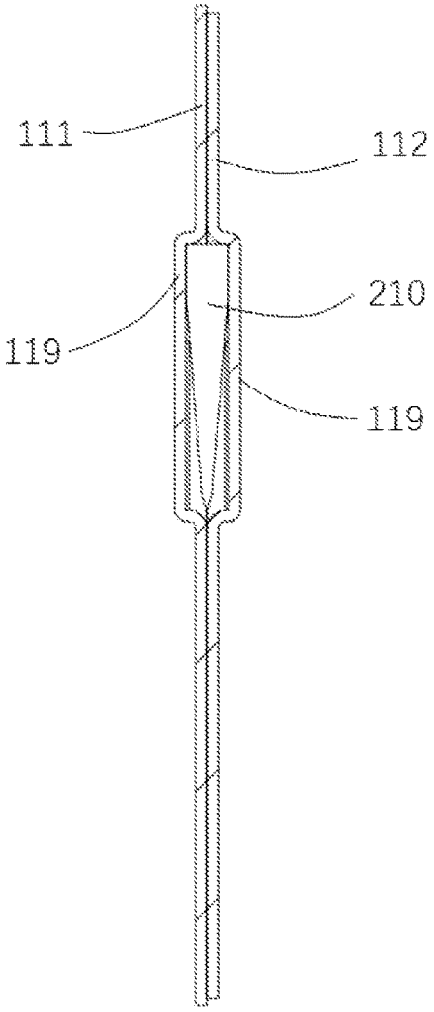
FIG. 8 is a schematic cross-sectional view of FIG. 7, taken along A-A.

FIGS. 1 to 10 show a first embodiment. According to this embodiment, as shown in FIGS. 1 and 3, a package arrangement 100 includes a first panel 111 and a second panel 112, which are disposed in opposition and affixed to each other to form a double-layer support board 110. Referring to FIGS. 2 and 4, the first panel 111 and the second panel 112 define therebetween a cavity 113, in which at least part of the hand tool 200 can be received. Referring to FIGS. 3 and 6, the first panel 111 defines a first opening 115 extending through a thickness thereof, and the second panel 112 defines a second opening 116 extending through a thickness thereof. The first 115 and second 116 openings are defined at substantially the same locations with respect to the respective panels and thereby form an opening 117 in the support board 110. Referring to FIGS. 1 and 2, the rest of the hand tool 200 that is not received in the cavity 113 is disposed in the opening 117. A combined cross-sectional shape of the cavity 113 and the opening 117 substantially matches a cross-sectional shape of the hand tool 200 that is received therein. Thus, the hand tool 200 can be disposed in the cavity 113 and the opening 117 so as to be secured within the package arrangement 100.

Figure 9:
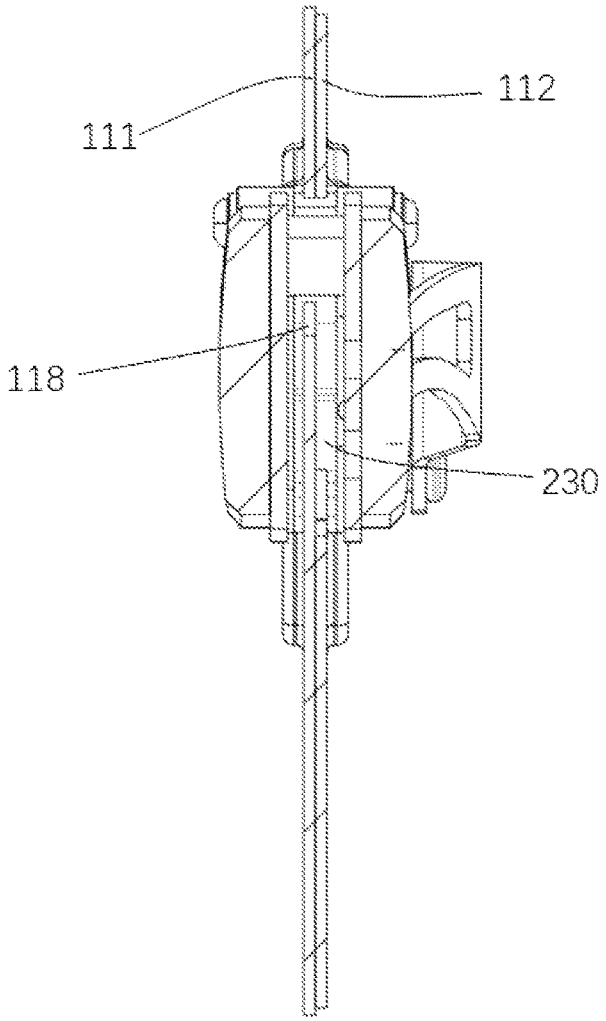
FIG. 9 is a schematic cross-sectional view of FIG. 7, taken along C-C.

In some embodiments, referring to FIGS. 5, 6 and 9, the first opening 115 has a smaller area than the second opening 116. Specifically, one edge of the first opening 115 is displaced inwards, thus defining an extension 118 serving as a retention structure. As a result, the first opening 115 has a smaller area than the second opening 116. As the extension 118 takes up part of the space of the opening 117, it can limit and thereby better secure the hand tool 200. This can prevent it from falling off during transportation or display, and from being stolen from sale.

The first panel 111 and the second panel 112 may be made of the same material. In this way, even if the first 111 and second 112 panels that are made of the same material are damaged as a result of taking the hand tool 200 out of the package arrangement 100, they can be directly subjected to waste sorting without being completely separated. Preferably, the first panel 111 and the second panel 112 are both made of paper materials and securely adhesively bonded to each other using heat and pressure. It is to be noted that the paper materials should not be selected as very thin paper sheets because such paper sheets would be easily torn. Preferably, the first panel 111 is selected as 300 g kraft cardboard, and the second panel 112 is selected as 350 g clay coated newsback (CCNB) cardboard. An embossing process may be performed on a region of each cardboard intended to accommodate the hand tool 200, forming an impression 119 that is raised 2 mm over the cardboard (see FIG. 3). Each impression 119 is raised outwards from the respective cardboard, allowing the cavity 113 to form between the two raised impressions 119 as a result of the two cardboards being adhesively bonded together. The raised impressions 119 have a shape matching that of the hand tool 200 to be placed therebetween. Generally, an emboss height over each cardboard is about 1.5-2 mm. In this case, the first panel 111 and the second panel 112 can be laminated together so that there is an approximately 3-5 mm wide space between the two raised impressions 119 (i.e., distance between the two panels). Preferably, the raised impressions 119 are 2 mm high.

Figure 10:
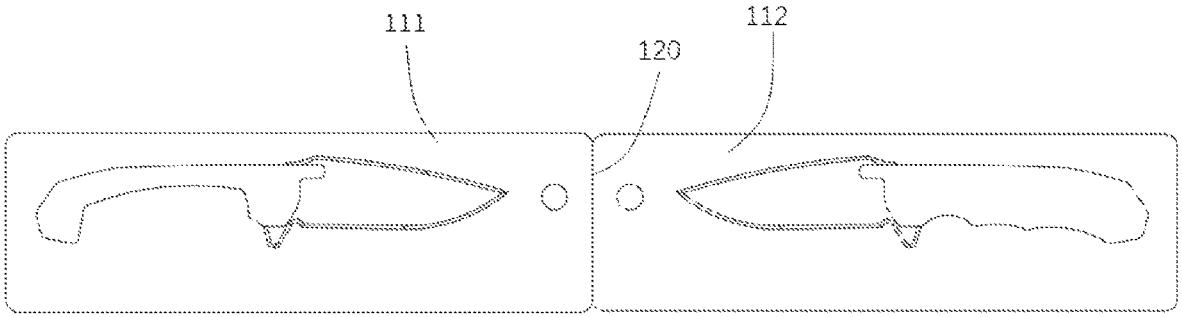
FIG. 10 schematically illustrates a first panel and a second panel, which are made of a single piece of cardboard.

In some embodiments, the first panel 111 and the second panel 112 are made from two separate pieces of cardboard and then joined together by pressure. In some embodiments, as shown in FIG. 10, the first panel 111 and the second panel 112 may be made from a single piece of cardboard so that they are joined along a line of intersection. Subsequently, they may be folded along the line of intersection 120 until they come into contact with each other. After that, they may be adhesively bonded to each other using pressure.

In some embodiments, the raised impressions 119 of the first panel 111 and the second panel 112 may be treated with UV radiation. Such a UV surface treatment is environmentally friendly and can retard fading or color change of ink on the panels caused by exposure to UV radiation in sunlight. Graphs delineating the shape of the goods to be packaged may be printed around the raised impressions 119 of the first panel 111 and the second panel 112, enabling the appearance of the packaged item to resemble its true shape. This may be followed by treatment with UV radiation, which makes the appearance of the packaged goods more aesthetically pleasing and facilitates a user's recognition of the packaged item.

Usage of a package arrangement 100 according to this embodiment is exemplified below in the context of a hand tool 200 being implemented as a folding knife.

As shown in FIGS. 1 and 3, the hand tool 200 to be packaged is a knife including a working end 220 and a handle 210. The handle 210 defines a channel 230 for stowing the working end 220. The knife is provided in the package arrangement 100 in an unfolded configuration (i.e., with the working end 220 being not stowed in the channel 230 of the handle 210).

A support board 110 as shown is provided, which has a first panel 111 and a second panel 112. The first panel 111 defines a first raised impression 119 at a location where the working end 220 is to be disposed and a first opening 115 at a location where the handle 210 is to be disposed. The second panel 112 defines a second raised impression 119 at a location where the working end 220 is to be disposed and a second opening 116 at a location where the handle 210 is to be disposed. The first raised impression 119 and the second raised impression 119 together delimit a cavity 113. The first opening 115 has a smaller area than the second opening 116. An edge of the first opening 115 is displaced inwards, thus defining an extension 118.

The knife is placed into the package arrangement 100 from the second opening 116 of the second panel 112 so that the working end 220 is inserted in the cavity 113, with the handle 210 being received in the second opening 116. Moreover, the extension 118 of the first panel 111 is inserted into the channel 230 of the handle 210, thereby limiting the handle 210 and facilitating securing of the knife.

The first panel 111 and the second panel 112 are affixed together so as to engage the knife with the support board 110 in a positionally restrictive manner. For example, the first panel 111 and the second panel 112 may be adhesively bonded using heat and pressure. Preferably, an adhesive for high-frequency bonding is applied between the first panel 111 and the second panel 112, followed by applying pressure to the panels and raising their temperature. As a result, the adhesive is heated and melted and bonds the two panels together. This adhesive meets the requirements relating to environmental friendliness and can be directly recycled without experiencing further processing. Therefore, its use does not affect the recycling of the support board 110.

In the package arrangement 100 of this embodiment, the two panels are made of the same material, in particular a paper material. Compared with blister packs, this reduces the use of hazardous materials such as plastics, making the product more environmentally friendly. The two panels may be securely engaged with each other using heat and pressure, or by stamping. This allows the package to be more easily opened, for example, because cutting the paper material is easier than cutting a plastic material. The first panel 111 and the second panel 112 can be directly subjected to waste sorting without being separated.

Example 2

FIGS. 11 to 16 show a second embodiment.

Figure 11:
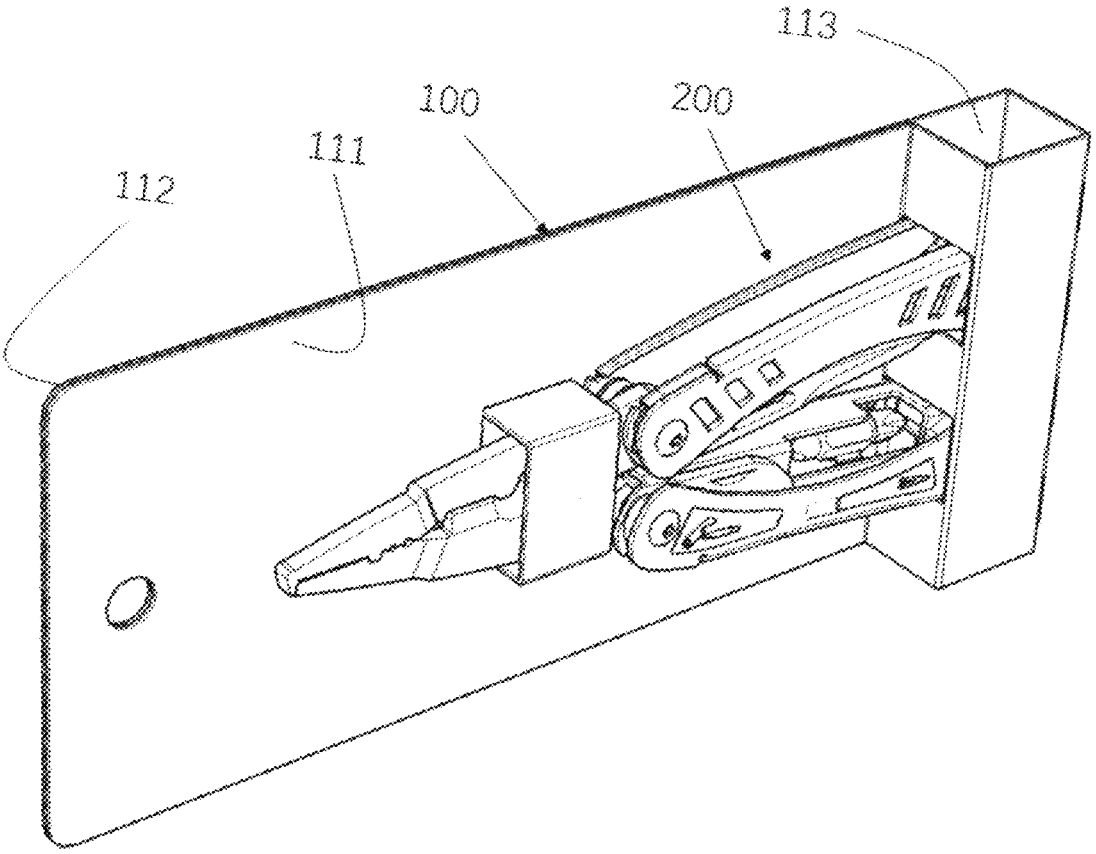
FIG. 11 is an isometric view of a second embodiment, showing a hand tool being packaged in a package arrangement.
Figure 12:
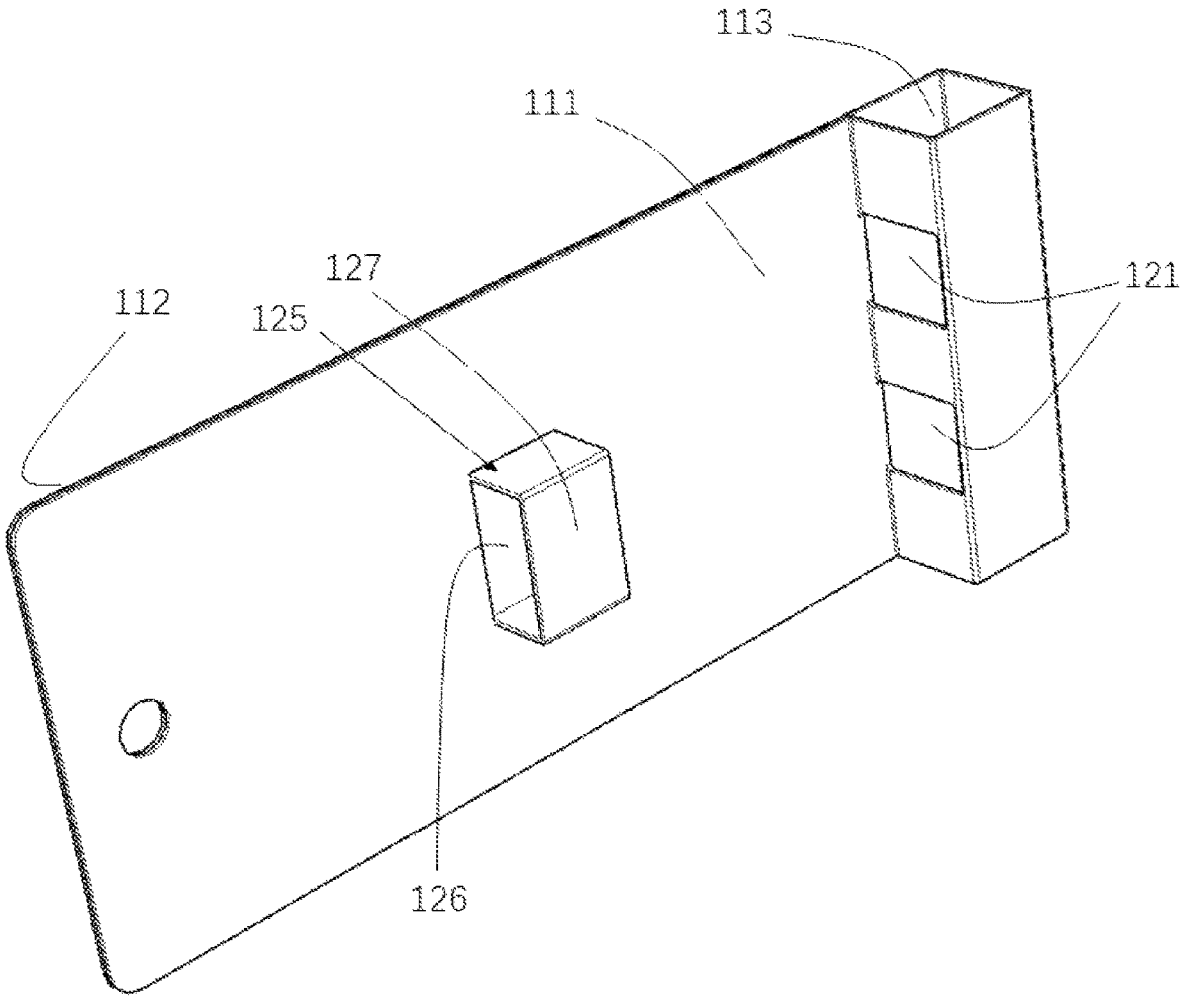
FIG. 12 is a schematic illustration of the package arrangement of the second embodiment, in which the hand tool has not been packaged yet.
Figure 13:
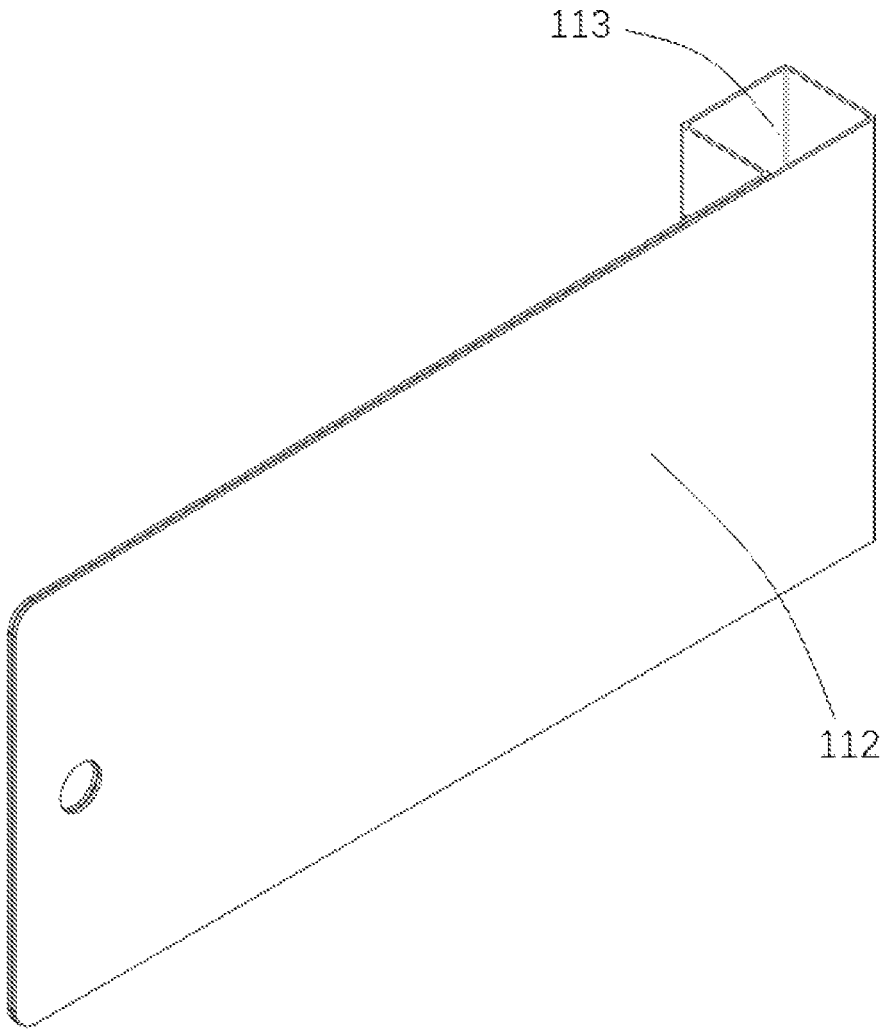
FIG. 13 is an isometric view of FIG. 12, taken from another angle.

As shown in FIGS. 11 and 12, in this embodiment, a package arrangement 100 is provided, which includes a support board 110 including a first panel 111 and a second panel 112. The first panel 111 and a second panel 112 are disposed in opposition and affixed to each other, making the support board 110 a double-layer structure. The first panel 111 and the second panel 112 define therebetween a cavity 113, in which at least part of a hand tool 200 can be received. The first panel 111 defines a plurality of openings including third openings 121 in communication with the cavity 113. The hand tool 200 partially extends into the cavity 113 through the openings and is thereby retained in the cavity 113 of the package arrangement 100. The first panel 111 further defines a fourth opening 122 for receiving part of the hand tool 200. An enclosure panel 125 is provided at the fourth opening 122 to form a retention structure. The enclosure panel 125 is joined to the fourth opening 122 and thereby defines an accommodating space 126 together with the support board 110, in which at least part of the hand tool 200 can be received.

Figure 14:
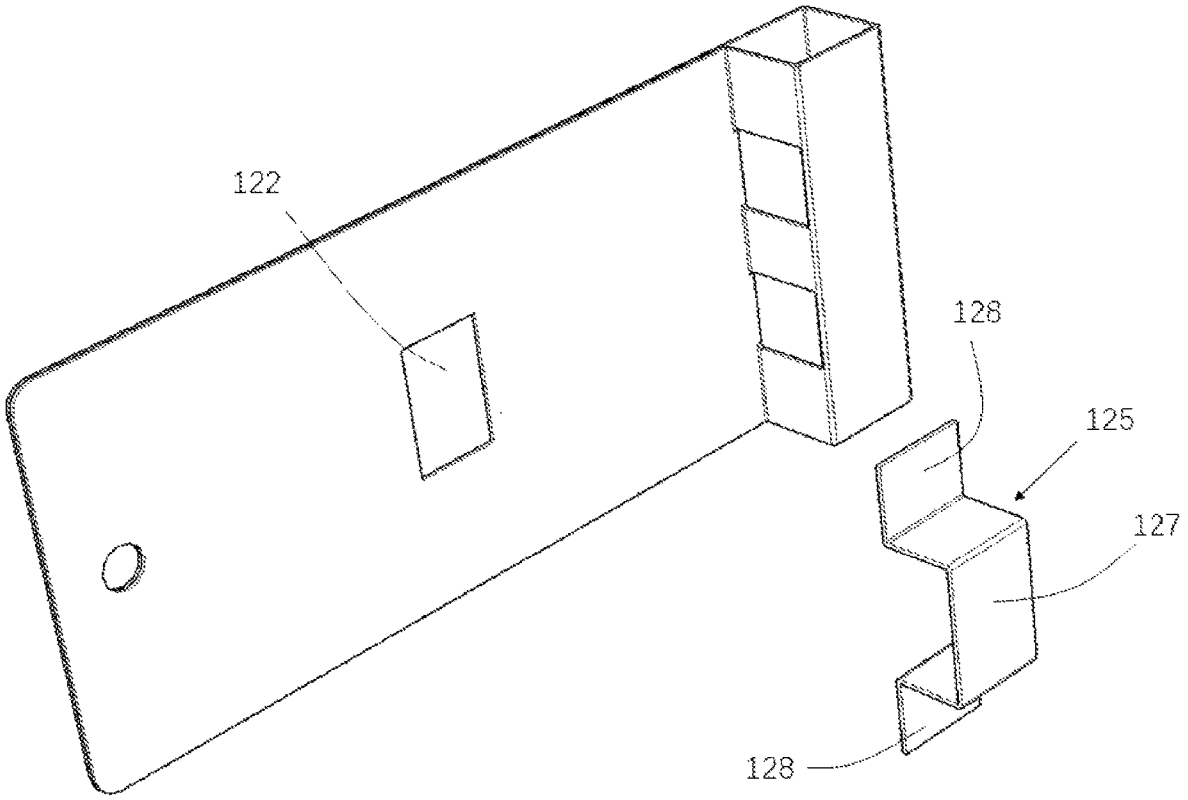
FIG. 14 is a schematic exploded view of FIG. 12.

As shown in FIG. 14, the enclosure panel 125 includes a top 127 and flanks 128 at opposite sides of the top 127. The flanks 128 pass through the fourth opening 122 of the first panel 111 and extend between the first panel 111 and the second panel 112. The top 127 is in opposite to the fourth opening 122 so that a space for receiving the hand tool 200 is defined between the top 127 and the fourth opening 122. With the enclosure panel 125, the hand tool 200 can be further restricted and better secured. It should be appreciated that the enclosure panel 125 is also applicable to the first embodiment. In this case, the cavity 113 of the first embodiment can be replaced with the combination of the enclosure panel 125 and the fourth opening 122. In addition, the enclosure panel 125 is made of the same material as the first panel 111 and the second panel 112, such as paper.

Figure 15:
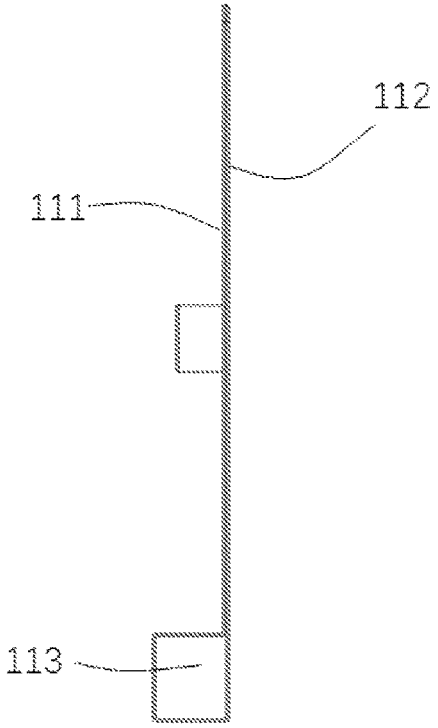
FIG. 15 is a side view of FIG. 12.
Figure 16:
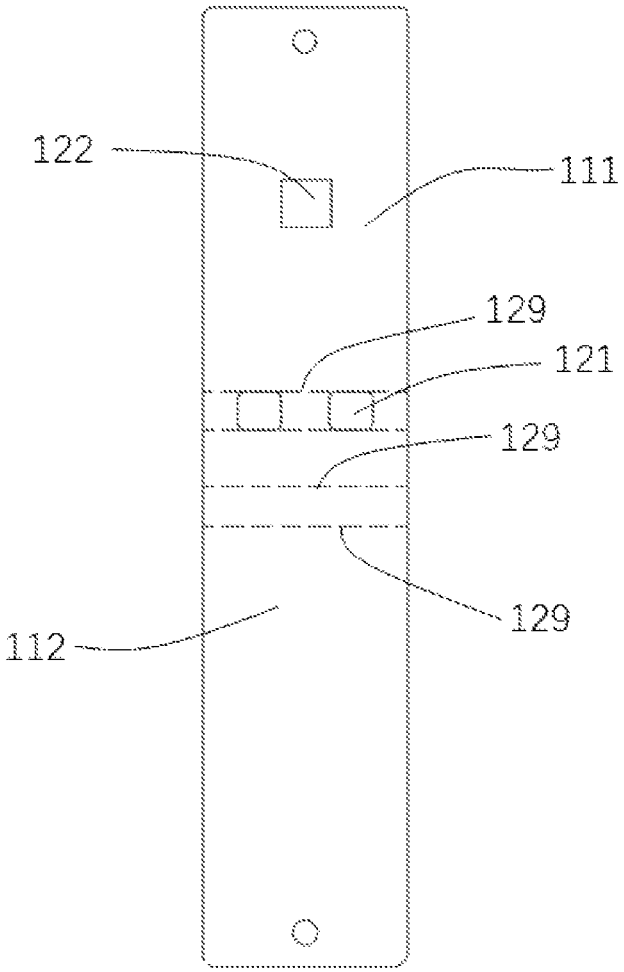
FIG. 16 is a schematic unrolled view of first and second panels in the second embodiment.

In some embodiments, the first panel 111 and the second panel 112 are made from separate pieces of paper, and an edge portion of the first panel 111 is folded to form the cavity 113. Specifically, as shown in FIGS. 12 and 15, a bottom edge portion of the first panel 111 may be folded thrice to form the cavity 113, which is substantially cuboid. The third openings 121 may be provided in a side wall of the cavity 113 that faces toward the fourth opening 122 of the first panel 111. The number of third openings 121 may be determined by the shape of the hand tool 200 to be packaged. In some embodiments, as shown in FIG. 16, the first panel 111 and the second panel 112 are made from the same piece of paper. In this case, a plurality of parallel first fold lines 129 may be defined on an edge portion of the first panel 111 that is contiguous with the second panel 112, and the first panel 111 may be folded along these first fold lines 129 so that the majority of the first panel 111 overlaps the second panel 112 and the cavity 113 is formed along an edge of the first panel 111.

It should be appreciated that this embodiment can be subjected to the same UV treatment as in the first embodiment.

Usage of a package arrangement 100 according to this embodiment is exemplified below in the context of a hand tool 200 being implemented as manual pliers.

The manual pliers include two handles 210 and a working end 220 (consisting of two jaws).

A support board 110 as shown is provided, which has a first panel 111 and a second panel 112. The first panel 111 defines a plurality of openings, and the first panel 111 and the second panel 112 define a cavity 113 therebetween. At least one opening of the plurality of openings is defined in a side wall of the cavity 113.

An enclosure panel 125 as shown is provided, which defines a top 127 and two flanks 128 in opposition to each other. The enclosure panel 125 is provided at an opening of the first panel 111 spaced away from the cavity 113. The two flanks 128 are passed through the opening and are joined between the first panel 111 and the second panel 112. The top 127 is in opposition to the fourth opening 122, thereby defining an accommodating space 126 for receiving the jaws.

The handles 210 of the manual pliers are passed through the opening(s) that is/are open to the cavity 113, and the jaws of the manual pliers are inserted into the accommodating space 126.

The first panel 111 and the second panel 112 are affixed to each other so that support board 110 engages with and retains the manual pliers. The two panels are affixed in the same manner as in the first embodiment.

It should be appreciated that, this embodiment can also be used to package other hand tools than the manual pliers.

Example 3

Figure 17:
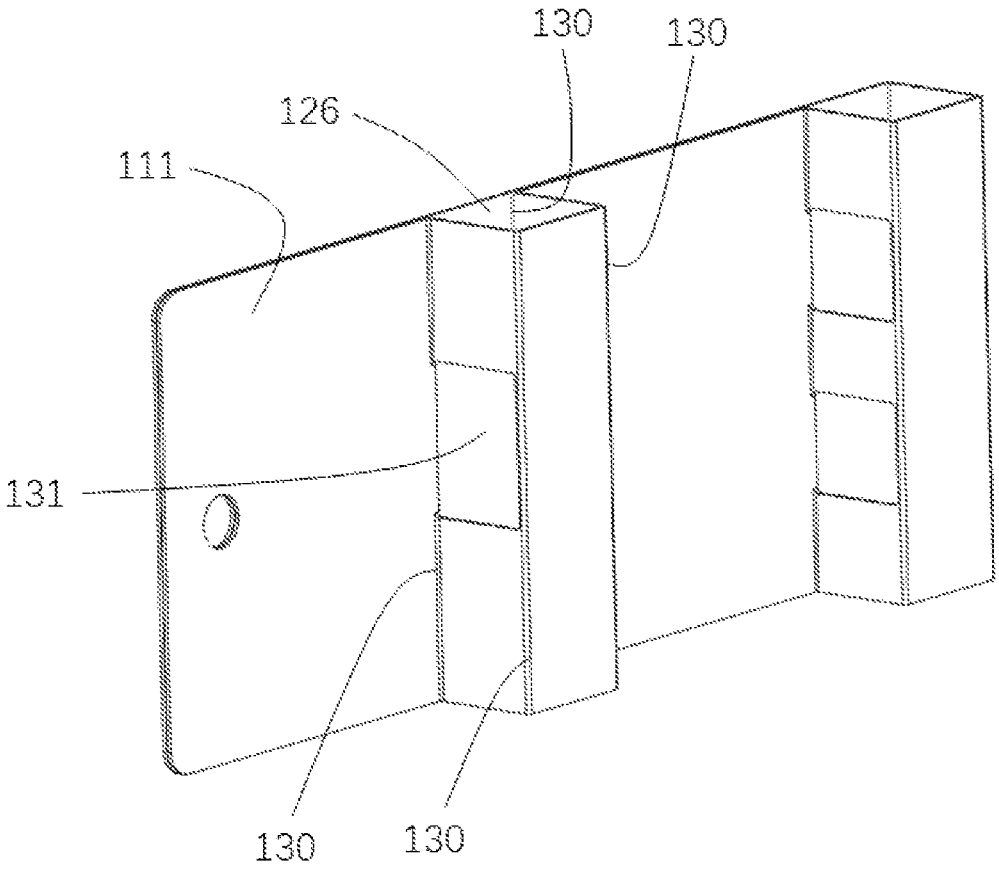
FIG. 17 is an isometric view of a package arrangement according to a third embodiment, without a hand tool being packaged therein.

A third embodiment differs from the second embodiment essentially in that, instead of defining the accommodating space 126 by joining the enclosure panel 125 to the first panel 111 according to the second embodiment, in this embodiment, as shown in FIG. 17, a first panel 111 is folded to define an accommodating space 126, which serves as a retention structure, and in which a working end 220 of a hand tool 200 can be received. A plurality of second fold lines 130 may be defined on the first panel 111, and the first panel 111 may be folded along these second fold lines 130 to form the accommodating space 126. A fifth opening 131 is provided on a side wall of the accommodating space 126, and the working end 220 can be passed through the fifth opening 131. Here, the accommodating space 126 is defined substantially in the same manner as the cavity 113 is defined by the first panel 111. Other features of this embodiment are the same as those of the second embodiment and, therefore, need not be described in further detail herein.

Preferred specific embodiments of the present invention have been described in detail above. It is to be understood that those of ordinary skill in the art can make various modifications and changes based on the concept of the present invention without exerting any creative effort. Accordingly, all variant embodiments that can be obtained by those skilled in the art by logical analysis, inference or limited experimentation in accordance with the concept of the present invention on the basis of the prior art are intended to fall within the protection scope as defined by the claims.

The invention claimed is:

1. A package arrangement, comprising a support board, the support board formed of at least two layers of plate laminated and affixed together, adjacent two plates of the at least two layers of plate defining therebetween a cavity for receiving at least part of a hand tool, each plate of the at least two layers of plate fabricated from a material satisfying recycling requirements for the same class of materials;

wherein the support board comprises a first panel and a second panel, which are laminated together and define the cavity therebetween;

wherein the first panel defines a first raised impression, with the second panel defining a second raised impression in positional correspondence with the first raised impression, the first raised impression and the second raised impression together delimiting the cavity.

2. The package arrangement of claim 1, wherein the support board defines at least one opening provided thereat with a retention structure configured to define a position for a portion of the hand tool that is not received in the cavity.

3. The package arrangement of claim 2, wherein the first panel defines a first opening, with the second panel defining a second opening in positional correspondence with the first opening.

4. The package arrangement of claim 3, wherein the retention structure comprises an extension formed by extending from an edge of the first opening into the first opening, the extension configured to extend into the hand tool so as to restrict the hand tool at a location allowing it to be taken out.

5. The package arrangement of claim 1, wherein the at least two layers of plate are made of paper materials.

6. The package arrangement of claim 5, wherein the at least two layers of plate are adhesively bonded using pressure by an adhesive which does not affect recycling.

7. The package arrangement of claim 1, wherein the first raised impression and the second raised impression have a height of 2 mm.

8. The package arrangement of claim 1, wherein the support board forms as a result of folding and laminating the first panel and the second panel, which are made from a single sheet of material.

9. A method of packaging a hand tool in a package, characterized comprising:

providing a support board which forms as a result of laminating and affixing at least two layers of plate, wherein adjacent plates of the at least two layers of plate define a cavity therebetween; the support board defines at least one opening provided thereat with a retention structure; and each plate of the at least two layers of plate is made of a material satisfying recycling requirements for the same class of materials;

placing at least part of the hand tool in the cavity and engaging a portion of the hand tool that is not placed in the cavity with the retention structure; and affixing the at least two layers of plate of the support board together;

wherein a first panel and a second panel are provided and laminated to form the support board, wherein the first panel defines a first raised impression and the second panel defines a second raised impression in positional correspondence with the first raised impression, the first raised impression and the second raised impression together delimiting the cavity; the first panel defines a first opening and the second panel defines a second opening in positional correspondence with the first opening; an edge of the first opening is extended into the first opening, thereby forming an extension; and wherein a working end of the hand tool is placed in the cavity, and a handle of the hand tool is placed in an opening consisting of the first opening and the second opening, with the extension extending into the hand tool.

10. The method of claim 9, wherein the support board is made of a paper material.

11. The method of claim 9, wherein the first panel and the second panel are made from a single sheet so that there is a line of intersection between the first panel and the second panel, along which the first panel and the second panel are then folded so as to be laminated together.

* * * * *